US007806740B1

(12) United States Patent
Taylor et al.

(10) Patent No.: US 7,806,740 B1
(45) Date of Patent: Oct. 5, 2010

(54) MARINE PROPULSION DEVICE WITH AN OIL TEMPERATURE MODERATING SYSTEM

(75) Inventors: Christopher J. Taylor, Fond du Lac, WI (US); Charles H. Eichinger, Oshkosh, WI (US); Nathan C. King, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 126 days.

(21) Appl. No.: 12/250,044

(22) Filed: Oct. 13, 2008

(51) Int. Cl.

| | |
|---|---|
| ***F01P 3/20*** | (2006.01) |
| ***F28F 9/02*** | (2006.01) |
| ***F28F 9/04*** | (2006.01) |
| *F01P 7/14* | (2006.01) |

(52) U.S. Cl. ..... 440/88 HE; 123/41.1

(58) Field of Classification Search ..... 440/88 R, 440/88 C, 88 HE; 123/41.1

See application file for complete search history.

(56) References Cited

U.S. PATENT DOCUMENTS

| | | | |
|---|---|---|---|
| 4,498,875 | A | 2/1985 | Watanabe |
| 5,746,170 | A | 5/1998 | Moriya |
| 5,769,038 | A | 6/1998 | Takahashi et al. |
| 5,876,256 | A | 3/1999 | Takahashi et al. |
| 5,937,801 | A | 8/1999 | Davis |
| 6,296,537 | B1 | 10/2001 | Toyama et al. |
| 6,358,108 | B2 | 3/2002 | Murata et al. |
| 6,409,557 | B1 | 6/2002 | Tsunekawa et al. |
| 6,416,372 | B1 | 7/2002 | Nozue |
| 6,425,790 | B2 | 7/2002 | Nakata et al. |
| 6,602,100 | B2 | 8/2003 | Tawa et al. |
| 6,699,086 | B1 | 3/2004 | Belter et al. |
| 6,821,171 | B1 | 11/2004 | Wynveen et al. |
| 6,851,992 | B2 | 2/2005 | Matsuo |
| 6,893,306 | B2 | 5/2005 | Shibata et al. |
| 7,082,903 | B2 * | 8/2006 | Hutchins ..... 123/41.1 |
| 7,318,396 | B1 | 1/2008 | Belter et al. |

* cited by examiner

*Primary Examiner*—Daniel V Venne
(74) *Attorney, Agent, or Firm*—William D. Lanyi

(57) ABSTRACT

An oil temperature moderating system of an outboard motor causes cooling water to be warmed to a predefined magnitude of temperature and then conducted through a temperature responsive valve to a coolant conduit, or coolant jacket, in thermal communication with oil within an oil sump of the outboard motor. In this way, the oil within the oil sump is continuously disposed in thermal communication with cooling water that has achieved a temperature controlled by a thermostat or similar device and, as a result, is above the temperature of the water drawn from a body of water in which the outboard motor is operated. This type of system reduces the temperature of oil in the oil sump when it is greater than the cooling water flowing through the thermostat and raises the temperature of oil in the oil sump when it is cooler than water flowing through the thermostat.

20 Claims, 5 Drawing Sheets

MARINE PROPULSION DEVICE WITH AN OIL TEMPERATURE MODERATING SYSTEM

BACKGROUND OF THE INVENTION

1. Field of the Invention

The present invention is generally related to a marine propulsion device and, more particularly, to a marine system for moderating the oil temperature of its lubricating system.

2. Description of the Related Art

Those skilled in the art of marine propulsion devices are familiar with many different systems which are intended to affect the temperature of oil used to lubricate certain surfaces of the device where friction could otherwise cause excessive wear and localized overheating. In some systems, oil coolers are used.

U.S. Pat. No. 4,498,875, which issued to Watanabe on Feb. 12, 1985, describes an outboard motor. An arrangement is provided that offers a compact nature and which uses the coolant delivered to the engine for cooling the oil in the oil pan. In addition, an arrangement is provided whereby the exhaust pipe may pass through the oil pan and yet avoid significant heat transfer from the exhaust system to the lubricating system.

U.S. Pat. No. 5,746,170, which issued to Moriya on May 5, 1998, describes an engine oil block for use in routing oil to an oil cooler. A thermostat is disposed in the oil block body. The oil block body is provided with an oil inlet passage connected on one side to the oil outlet of an engine block and on the other side to the oil inlet of an oil cooler. The oil block has an oil outlet passage connected on one side to the oil inlet of the engine block and on the other side to the oil outlet of the oil cooler.

U.S. Pat. No. 5,769,038, which issued to Takahashi et al. on Jun. 23, 1998, describes a liquid cooling system for an engine. The liquid cooling arrangement includes a pump for pumping cooling liquid from a cooling liquid source first through at least one passage extending through the cylinder head generally adjacent the exhaust passages leading from the combustion chambers and through at least one passage extending through the cylinder block generally adjacent the common exhaust passage.

U.S. Pat. No. 5,876,256, which issued to Takahashi et al. on Mar. 2, 1999, describes an engine cooling system for an outboard motor. It includes a pump for delivering coolant to one or more coolant passages of the engine. At least one thermostat is provided for controlling the flow of coolant through the engine to one or more return lines which extend to a coolant pool extending about a lubricating oil reservoir. A pressure relief valve is provided between the pump and thermostat for relieving coolant from the engine upon excessive coolant pressure. When a temperature of the lubricating oil is high, the relieved coolant is preferably diverted to the first coolant pool for additionally cooling the oil in the reservoir and when the temperature of the oil is low, the relieved coolant is preferably either diverted to the second coolant pool or the coolant drain for passage out of the motor.

U.S. Pat. No. 5,937,801, which issued to Davis on Aug. 17, 1999, discloses an oil temperature moderator for internal combustion engine. A cooling system is provided for an outboard motor or other marine propulsion system which causes cooling water to flow in intimate thermal communication with the oil pan of the engine by providing a controlled volume of cooling water at the downstream portion of the water path. As cooling water flows from the outlet of the internal combustion engine, it is caused to pass in thermal communication with the oil pan. Certain embodiments also provide a pressure activated valve which restricts the flow from the outlet of the internal combustion engine to the space near the oil pan. One embodiment of the cooling system also provides a dam within the space adjacent to the outer surface of the oil pan to divide that space into first and second portions. The dam further slows the flow of water as it passes in thermal communication with the oil pan.

U.S. Pat. No. 6,296,537, which issued to Toyama et al. on Oct. 2, 2001, describes an outboard motor that includes an engine holder, an engine disposed above the engine holder in a state of the outboard motor being mounted to a hull, an oil pan disposed below the engine holder, and a driveshaft housing disposed below the oil pan. Exhaust passages are formed in the engine holder and in the oil and adapted to exhaust an exhaust gas from the engine into the driveshaft housing, one exhaust passage formed to the oil pan has a downstream side and opening, and an exhaust tube is provided for a bottom surface portion of the oil pan so as to align with the downstream side end opening of the exhaust passage.

U.S. Pat. No. 6,358,108, which issued to Murata et al. on Mar. 19, 2002, describes an outboard motor that includes a first case and a second case disposed below the first case. The first case houses therein an oil pan and an upper part of the driveshaft. Within the oil pan, engine oil is held. The second case has an upper edge portion coupled to a lower edge portion of the first case. A cavity is formed below the oil pan. The arrangement prevents the oil pan from being affected by heat of the exhaust gas.

U.S. Pat. No. 6,409,557, which issued to Tsunekawa et al. on Jun. 25, 2002, describes an exhaust arrangement for an outboard motor. It is associated with a lubricant tank and a cooling system. The cooling system provides a pool or bath of coolant between the exhaust pipe and the lubricant tank to inhibit excessive heating of these components during normal and abnormal running conditions.

U.S. Pat. No. 6,416,372, which issued to Nozue on Jul. 9, 2002, describes an outboard motor cooling system. It includes an improved construction to enhance cooling of the lubrication system, particularly an oil pan of the lubrication system. The oil pan depends from an engine of the outboard motor and into a driveshaft housing. A periphery coolant jacket is provided around the oil pan. A water pool is defined between the oil pan and the driveshaft housing. At least one of an upper and lower transverse water jacket extends transversely above or below the oil pan. No drain water from the engine flows through these jackets or passages. The oil pan therefore is sufficiently cooled. In addition, the upper transverse water jacket increases protection of engine components from heat deterioration.

U.S. Pat. No. 6,425,790, which issued to Nakata et al. on Jul. 30, 2002, describes an exhaust arrangement for an outboard motor. The downstream exhaust pipe can be removed independently of the upstream exhaust pipe and can be drawn downwardly through an opening during removal. This enables the downstream exhaust pipe to be easily and quickly replaced.

U.S. Pat. No. 6,602,100, which issued to Tawa et al. on Aug. 5, 2003, describes a passage wall cooling structure in an outboard engine system. It includes a case member which is disposed below an engine body and integrally provided with an oil pan opening upwards, and a passage wall extending vertically to define an exhaust gas passage through which exhaust gas flows. A passage wall is integral with the oil pan and is cooled effectively, while avoiding increases in size and weight.

U.S. Pat. No. 6,699,086, which issued to Belter et al. on Mar. 2, 2004, discloses a coolant management system for a marine propulsion device. It provides a cavity within a driveshaft housing into which an oil reservoir is disposed. A water pump draws water from a body of water and causes it to flow through various coolant passages of the marine propulsion device. After passing through the coolant passages, the water is directed through a series of containments and compartments so that the level of water within the driveshaft housing varies in depth as a function of the operating speed of the internal combustion engine. This variance in depth causes a varying degree of cooling of the oil within the oil reservoir or sump.

U.S. Pat. No. 6,821,171, which issued to Wynveen et al. on Nov. 23, 2004, discloses a cooling system for a four cycle outboard engine. The system is intended for use with a marine engine and conducts water from a coolant pump through the cylinder head and exhaust conduit prior to conducting the cooling water through the cylinder block. This raises the temperature of the water prior to its entering the coolant passages of the cylinder block.

U.S. Pat. No. 6,851,992, which issued to Matsuo on Feb. 8, 2005, describes a cooling system for a jet propulsion boat. The number of components is reduced and the construction is simplified. A cooling system for a jet propulsion boat is a system in which the jet propulsion unit is provided at a rear portion of the vessel body. An opening of an opened valve body is varied according to the primary pressure in an engine cooling flow path.

U.S. Pat. No. 6,893,306, which issued to Shibata et al. on May 17, 2005, describes a cooling arrangement for an outboard motor. An intermediate unit is coupled with a housing unit to support the engine above the housing unit. An exhaust conduit discharging exhaust gases from the engine depends from the intermediate unit to extend generally vertically within the housing unit. The intermediate unit assigns a coolant passage having a discharge port spaced apart from an outer surface of the exhaust conduit. A guide member is arranged to guide the coolant discharged from the discharge port toward the outer surface of the exhaust conduit.

U.S. Pat. No. 7,318,396, which issued to Belter et al. on Jan. 15, 2008, discloses a cooling system for a marine propulsion engine. It incorporates first and second thermally responsive valves which are responsive to increases in temperature above first and second temperature thresholds, respectively. The two thermally responsive valves are configured in serial fluid communication with each other in a cooling system, with one thermally responsive valve being located upstream from the other.

The patents described above are hereby expressly incorporated by reference in the description of the present invention.

Marine propulsion systems present severe problems with regard to the temperature of lubricating oil. Steps must be taken to prevent the lubricating oil from being overheated. However, problems can also be caused if the lubricating oil is overcooled. More specifically, condensation of fuel vapor can be induced if the engine surfaces are below an advantageous temperature magnitude. This condensed fuel can then accumulate within an oil sump because of the fact that the oil is continually recirculated between lubricated surfaces of the engine and the sump. It is therefore advantageous to control the temperature of the oil within a desirable range and avoid the temperature from being either too hot or too cold. It would therefore be significantly beneficial if a system could be provided which moderates the temperature of the oil under many different conditions of use.

SUMMARY OF THE INVENTION

A marine propulsion device made in accordance with a preferred embodiment of the present invention comprises an engine, a water jacket disposed in thermal communication with at least one heat producing portion of the engine, a water pump, a water inlet conduit of the water jacket connected in fluid communication with the water pump, a water outlet conduit connected in fluid communication with the water jacket, a temperature responsive valve connected in fluid communication with the water outlet conduit and configured to permit cooling water within the water jacket to flow out of the water outlet conduit when the temperature of the cooling water exceeds a predefined magnitude, an oil sump configured to contain a quantity of oil for recirculation between the oil sump and lubricated surfaces of the engine, and a coolant conduit connected to the water outlet conduit and disposed in thermal communication with the oil sump. The cooling water is directed to flow in thermal communication with the quantity of oil after it passes through the water jacket and reaches a temperature which exceeds a predefined magnitude.

The coolant conduit can be a coolant jacket which surrounds a portion of the oil sump. The system, in a preferred embodiment of the present invention, can further comprise a water discharge conduit connected in fluid communication with the coolant conduit. The water pump can be configured to draw the cooling water from a body of water and induce the cooling water to flow through the water inlet conduit and through the water jacket of the engine. The cooling water is heated by thermal communication with at least one heat producing portion of the engine and then subsequently conducted through the temperature responsive valve, the water outlet conduit and the water discharge conduit to be returned to the body of water. The temperature responsive valve, the oil sump, and the coolant conduit can be configured to raise the temperature of the quantity of oil when the temperature of the oil is less than the predefined magnitude and, alternatively, to lower the temperature of the quantity of oil when the temperature of the oil is greater than the predefined magnitude. The system can further comprise a flow directing component configured to cause the quantity of oil to flow in contact with surfaces of the oil sump which are in direct thermal contact with the coolant conduit as the quantity of oil returns to the oil sump from the lubricated surfaces of the engine. This flow directing component can comprise at least one plate which directs the flow of oil into contact with side and/or bottom surfaces of the oil sump.

In certain embodiments of the present invention, the temperature responsive valve is a thermostat which is disposed in thermal communication with the cooling water within the water jacket of the engine. In alternative embodiments, the temperature responsive valve can comprise a valve connected in electrical communication with a controller, such as a microprocessor, which is connected in signal communication with a temperature sensor. The temperature sensor can be disposed in thermal communication with the cooling water within the water jacket of the engine. The marine propulsion device can be an outboard motor.

In certain embodiments of the present invention, a pressure sensitive valve can be provided which allows water to flow from the water jacket of the engine to the oil sump regardless of the temperature of the water in the water jacket if the pressure of the water within the water jacket exceeds a predetermined magnitude.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 3:
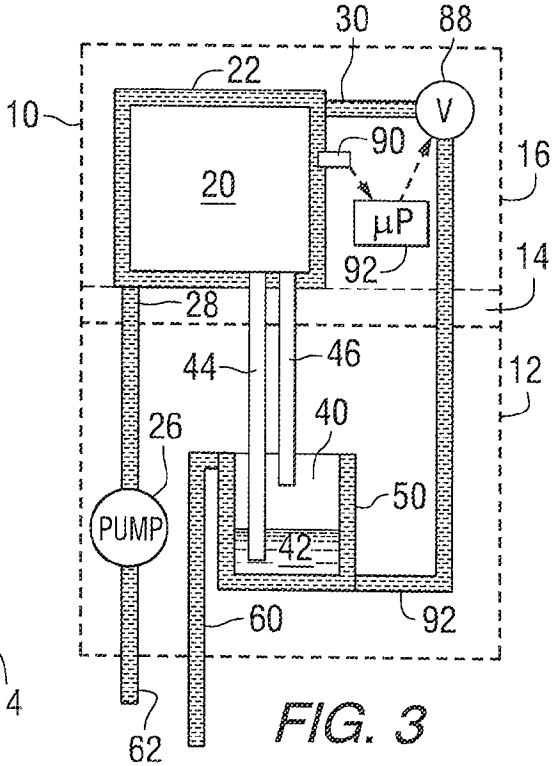
FIG. 3 shows an alternative embodiment of the present invention in which a controller, such as a microprocessor, is used in conjunction with a temperature sensor to control the flow of coolant from a water jacket of the engine and through a solenoid controlled valve.

Throughout the description of the preferred embodiment of the present invention, like components will be identified by like reference numerals.

Figure 1:
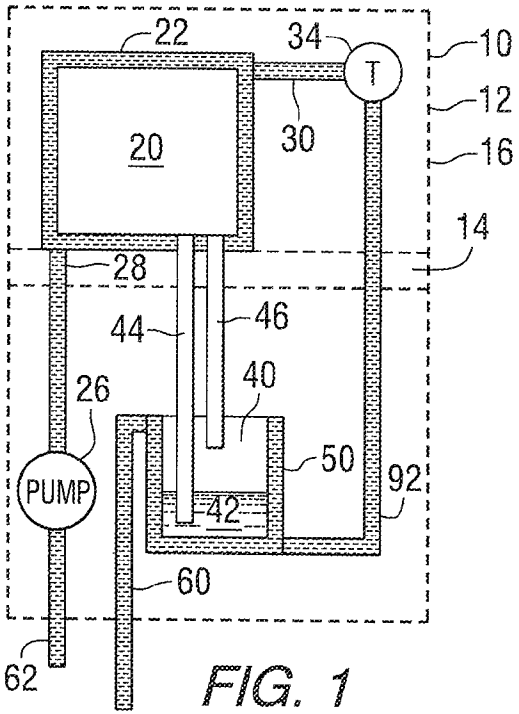
FIG. 1 is a highly schematic representation of an outboard motor incorporating a preferred embodiment of the present invention.

FIG. 1 is a highly schematic representation of an outboard motor 10. Dashed line boxes show the relative locations of the driveshaft housing 12, an adapter plate 14, and a cowl 16. Above the adapter plate, an engine 20 is shown with a water jacket 22 disposed in thermal communication with at least one heat producing portion of the engine 20. A water pump 26 draws water from a body of water in which the outboard motor 10 is operated. A water inlet conduit 28 of the water jacket 22 is connected in fluid communication with the water pump 26. A water outlet conduit 30 is connected in fluid communication with the water jacket 22 and a temperature responsive valve 34 is connected in fluid communication with the water outlet conduit 30 and configured to permit cooling water within the water jacket 22 to flow out of the water outlet conduit 30 when the temperature of the cooling water exceeds a predefined magnitude. An oil sump 40 is configured to contain a quantity of oil 42 for recirculation between the oil sump 40 and lubricated surfaces of the engine 20. Although not shown in FIG. 1, an oil pump is used to draw oil 42 from the oil sump 40 through conduit 44 and deliver that oil to various lubricated surfaces of the engine 20. The oil is then allowed to drain downwardly, as represented by conduit 46, to the oil sump 40. It should be understood that conduit 46 represents the downward flow of oil from the engine 20 to the oil sump 40, but in many types of outboard motor engines, the returning oil flows along numerous paths under the effect of gravity and is not literally conducted through a definable conduit such as that identified by reference numeral 46.

With continued reference to FIG. 1, a coolant conduit 50 is connected to the water outlet conduit 30 and disposed in thermal communication with oil 42 within the oil sump 40. As a result, cooling water is directed to flow in thermal communication with the quantity of oil 42 after the cooling water passes through the water jacket 22 of the engine and reaches a temperature which exceeds the predefined magnitude which is controlled by the temperature responsive valve 34.

With continued reference to FIG. 1, the coolant conduit 50 in a preferred embodiment of the present invention is a coolant jacket which surrounds at least a portion of the oil sump 40. This coolant jacket can surround the entirety of the side walls and/or bottom surfaces of the oil sump 40 or, in some embodiments of the present invention, can surround portions of the side walls if the physical structure of the oil sump in combination with other components, such as exhaust conduits, prohibits the coolant jacket 50 from completely surrounding the oil sump 40. A water discharge conduit 60 is connected in fluid communication with the coolant conduit 50 to allow the coolant water to be returned to the body of water from which it was drawn by the pump 26 through conduit 62. The water pump 26 is configured to draw the cooling water from the body of water and induce the cooling water to flow through the water inlet conduit 28 and the water jacket 22. This water flows under pressure from the pump 26 into the cooling jacket 22. The cooling water is heated by thermal communication with at least one heat producing portion of the engine 20 and then is subsequently conducted through the temperature responsive valve 34 when it exceeds the predefined temperature that is determined by the valve 34. The water flows from the coolant jacket 22, through the water outlet conduit 30, the temperature responsive valve 34, the coolant conduit 50, and the water discharge conduit 60 to be returned to the body of water. The temperature responsive valve 34, the oil sump 40, and the coolant conduit 50 are configured to raise the temperature of the quantity of oil 42 when the temperature of the quantity of oil is less than the predefined magnitude of the temperature controlled by the temperature responsive valve 34 and, alternatively, to lower the temperature of the quantity of oil 42 when the temperature of the quantity of oil is greater than the predefined magnitude of temperature controlled by the temperature responsive valve 34.

Figure 2:
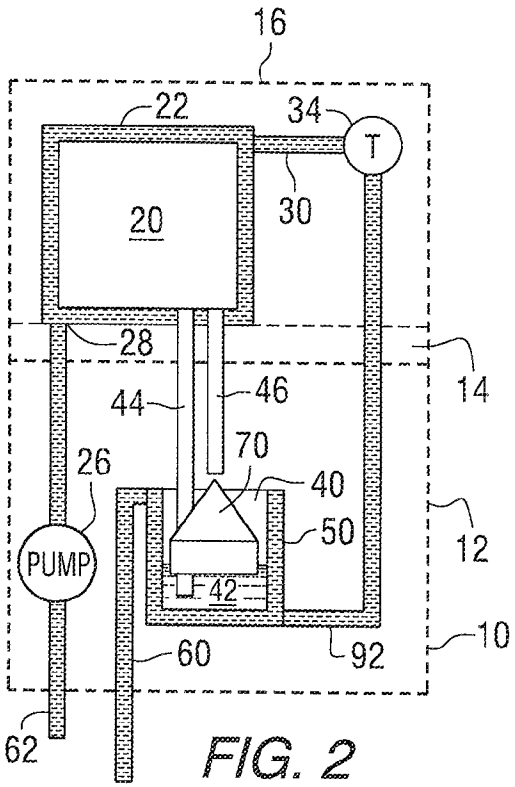
FIG. 2 is generally similar to FIG. 1, but showing a flow directing component used in certain alternative embodiments of the present invention.
Figure 4:
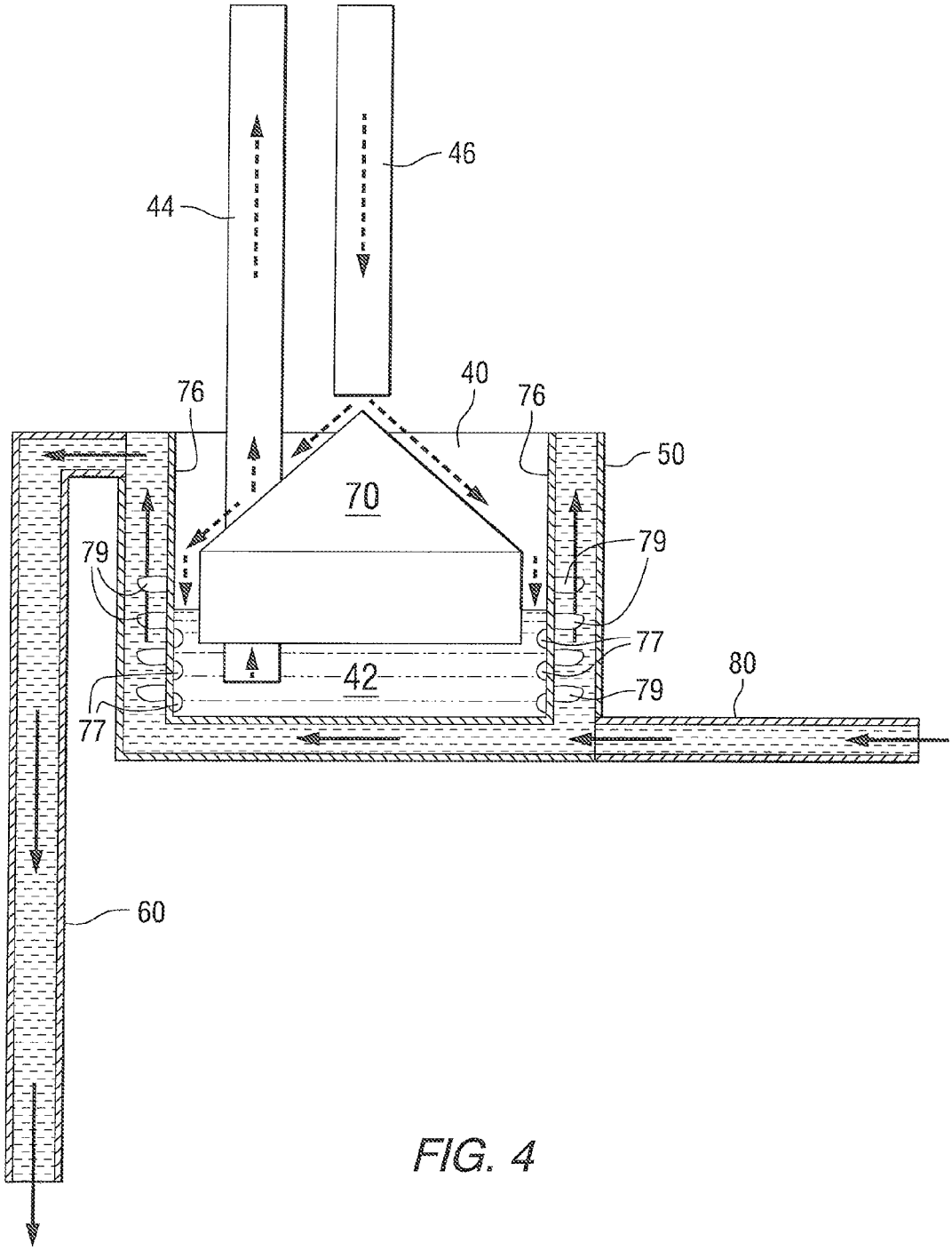
FIG. 4 is an enlarged view of a portion of FIG. 2.

FIG. 2 illustrates an alternative embodiment of the present invention which further comprises a flow directing component which is configured to cause the quantity of oil returning from the engine 20 to the sump 40 to flow in more direct contact with surfaces of the oil sump 40 which are in thermal contact with the coolant conduit 50 as the oil returns to the sump from the lubricated surfaces of the engine 20. FIG. 4 is an enlarged view of the oil sump 40 with the flow directing component 70.

With continued reference to FIGS. 2 and 4, the oil cascades downward, under the influence of gravity, from the engine 20 toward the oil sump 40. Although many different configurations of the flow directing component 70 are possible within alternative embodiments of the present invention, the simplified conical shape illustrated in FIG. 2 and the simplified cone with additional side walls illustrated in FIG. 4 cause the cascading oil, represented by dashed line arrows in FIG. 4, to be directed toward and against the sides, 76, of the sump 40 in order to improve the transfer of heat from the oil to the water flowing through the coolant conduit 50 which, as described above, is a jacket surrounding the quantity of oil 42 in a preferred embodiment of the present invention. The purpose of the flow directing component 70 is to cause this improved heat transfer between the oil, represented by dashed line arrows in FIG. 4, and the water within the coolant conduit 50. It is important to realize that this transfer of heat between the oil 42 and the water in the coolant conduit 50 can be in either direction, either lowering the temperature of the oil 42 or raising it. One of the primary purposes of the present invention is to moderate the temperature of oil to the desired range of temperatures and not merely to raise or to lower the temperature of the oil. This is particularly important in outboard motors which can be operated in water temperatures that can be as low as 32 degrees Fahrenheit and as high as 90 degrees Fahrenheit or more. In addition, the outboard motor can be operated at idle speed for an extended duration or can be operated at cruising speed for extended periods of time. The variability of both the water temperature and the manner in which the outboard motor is operated can result in oil 42 being either too cold or too hot. The present invention, in its preferred embodiments, is directed to moderating that temperature to a desirable range. This can extend the operating life of the outboard motor by reducing the likelihood that the oil is either destroyed by overheating or caused to accumulate condensed gasoline due to overcooling. These problems are directly related to the fact that outboard motors typically use lake water, or sea water, to cool its heat producing components.

In certain embodiments of the present invention, surface discontinuities can be used to enhance the conduction of heat between the oil 42 and the water within the coolant conduit 50. In FIG. 4, two types of surface discontinuities are illustrated. It should be understood that the particular shape or configuration of the discontinuities is not limiting to the present invention. The purpose of the discontinuities is twofold. First, the discontinuities increase the effective surface area and therefore improve the heat conduction through the wall on which the surface is located. In addition, the discontinuities can increase turbulence of fluid flow and, as a result, enhance the heat conductivity between the oil and water. In FIG. 4, a plurality of bumps 77 are shown on the sides 76 of the sump 40. These bumps 77 extend into the oil 42. In addition, fins 79 are formed on the walls 76 and extend into the water within the coolant conduit 50. As the water flows through the coolant conduit 50, the fins 79 increase its turbulence and improve the heat conductivity between the water and the oil 42. In addition, the fins increase the effective surface area of the walls 76 and increase the thermal conductivity between the oil 42 and water within the coolant conduit 50. The number and shape of the discontinuities, 77 and 79, can be varied to suit the specific applications of the present invention. In a particularly preferred embodiment of the present invention, these discontinuities extend into both the oil 42 and the water within the coolant conduit 50.

With continued reference to FIG. 4, the direction of water flow is represented by solid line arrows and the direction of oil flow is represented by dashed line arrows. The water flow is shown passing through a conduit identified by reference numeral 80 as it flows from the temperature responsive valve 34 described above in conjunction with FIGS. 1 and 2. The water flow continues through the water jacket, or coolant conduit 50, and then through the water discharge conduit 60 to be returned to the body of water. The oil flow is induced upwardly through conduit 44 to the lubricated surfaces of the engine and then returned, usually by cascading under the effects of gravity, from those lubricated surfaces back to the oil sump 40. The oil 42 is continuously recirculated in this manner.

Figure 5:
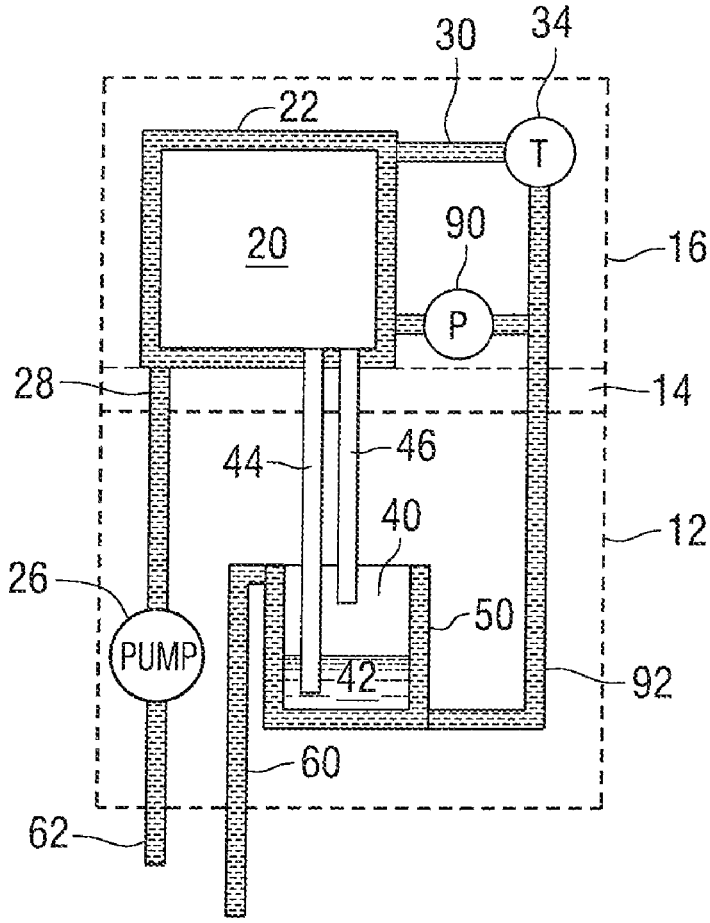
FIG. 5 shows an embodiment of the present invention which incorporates both a temperature responsive valve and a pressure responsive valve.

With reference to FIG. 3, an outboard motor 10 similar to that described above in conjunction with FIG. 1 is illustrated. However, the embodiment illustrated in FIG. 3 comprises a slightly different type of temperature responsive valve 88 in conjunction with a temperature sensor 90 and a controller, or microprocessor 92. In a typical embodiment of the present invention, as described above in conjunction with FIG. 1, the temperature responsive valve 34 is a relatively conventional thermostat. The embodiment in FIG. 3 comprises an electrically controlled valve 88 that is connected in electrical communication with a microprocessor 92 which, in turn, is connected in signal communication with the temperature sensor 90. The microprocessor receives a signal from the temperature sensor 90 and controls the valve 88, which can be a solenoid controlled valve, to govern the flow of water from the water jacket 22 toward the oil sump 40. Otherwise, the embodiment shown in FIG. 5 is generally similar to those described above in conjunction with FIGS. 1 and 2. Regardless of whether a thermostat 34 or a solenoid operated valve 88 is used, an important characteristic of the present invention is that water is caused to flow out of the water jacket 22 to the oil sump 40 when the water in the water jacket achieves a predefined temperature. Typically, this predefined temperature is approximately 140 degrees Fahrenheit.

FIG. 5 shows another embodiment of the present invention which combines the operation described above in conjunction with FIG. 1-4 with an additional valve 90 that is pressure sensitive. The pressure sensitive valve 90 is connected in fluid communication between the water jacket 22 and the conduit 92 that is connected to the coolant conduit 50, or coolant jacket surrounding the oil sump 40. Water within the water jacket 22 of the engine 20 can be conducted through conduit 92 either in response to an opening of the temperature sensitive valve 34, as described above, or in response to the opening of the pressure responsive valve 90. The use of a pressure responsive valve in conjunction with oil sumps and cooling water flow is described in detail in U.S. Pat. No. 5,937,801 which is discussed above. The embodiment of the present invention shown in FIG. 5 can be particularly useful in certain situations in which a rapid increase in operating speed of the engine 20 occurs. In situations when the engine is caused to operate at high speed before the thermostat 34 has an opportunity to begin conducting water through the water jacket 22, the oil 42 within the engine 20 may be rapidly heated through thermal contact with heat producing regions of the engine. When the operating speed of the engine 20 is rapidly increased, the pressure of water within the water jacket 22 increases quickly because of the increased speed of operation of the water pump 26. This increased pressure will induce the pressure responsive valve 90 to open and allow water to flow out of the water jacket 22 and toward the coolant conduit 50 through conduit 92. The provision of the pressure sensitive valve 90 allows the oil 42 to be more rapidly cooled during periods of sudden increased engine speed prior to the response of the temperature responsive valve 34 and improves the cooling capacity of the system.

Figure 6:
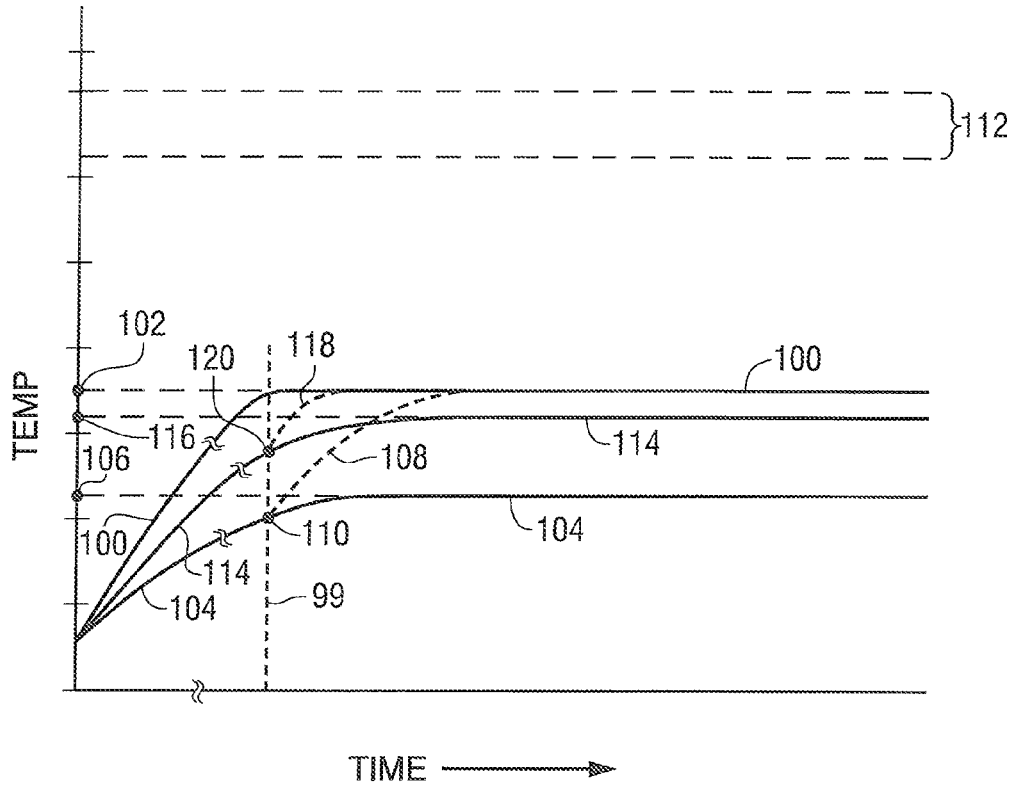
FIG. 6 shows a time based graphical representation of water and oil temperature variations in both cold and warm temperatures when the outboard motor is operated at idle speed.
Figure 7:
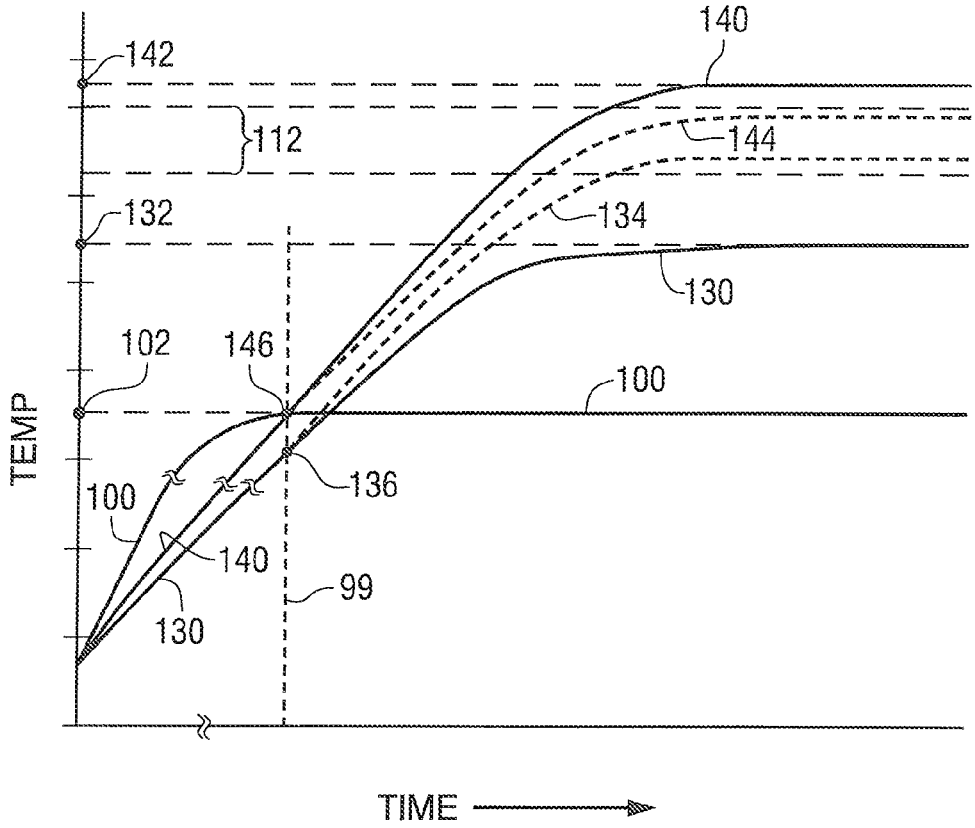
FIG. 7 is a graphical time based representation of water and oil temperatures when an outboard motor is operated at cruising speed in both cool and warm temperatures.

Some of the benefits of a preferred embodiment of the present invention will be described in conjunction with FIGS. 6 and 7 which graphically represent the exemplary changes in water and oil temperature as a function of time. FIGS. 6 and 7 are intended to graphically describe hypothetical circumstances involving different operating speeds of the engine, different water temperatures of the body of water in which the engine is operated, and different types of systems which either employ the embodiments of the present invention or not.

With reference to FIGS. 1-6, line 100 in FIG. 6 represents the magnitude of temperature of the water within the cooling jacket 22 of the engine 20 as a function of time. In order to more clearly compare the various circumstances which will be described below, the lines in FIG. 6 are broken to allow the various graphical relationships to be expressed as a function of a common time, represented by dashed line 99, when the temperature responsive valve, 34 or 88, opens to allow water to flow from the cooling jacket 22 through conduit 92 to the coolant conduit 50 surrounding the oil sump 40. It should be understood that the specific time, measured in minutes, when this occurs, will vary significantly based on the temperature of the body of water, the operating speed of the engine, the particular design of the cooling passages of the engine 20, and the relative positions of the oil sump 40 and exhaust conduits of the engine 20. By breaking the line as shown in FIGS. 6 and 7, they can be compared relative to their common time 99 when water begins to flow from the cooling jacket 20 to the coolant conduit 50.

With continued reference to FIG. 6, line 100 represents the temperature of the water within the cooling jacket 22 of the engine 20. The temperature continues to rise from the time the engine is started until the water within the cooling jacket 22 achieves the predefined temperature magnitude that causes the temperature responsive valve 34 to open at time 99. From that point on, the temperature of the water in the cooling jacket remains relatively constant. In most applications of the present invention, the temperature maintained by the temperature responsive valve is typically equal to approximately 140 degrees Fahrenheit as represented by point 102. When operated in very cold water, the oil temperature in the oil sump 40 without the use of the present invention would typically follow a temperature pattern represented by line 104. When operated on a very cold day, the use of lake water to cool the components of an engine 20 and oil sump 40 would typically result in the oil temperature getting no warmer than approximately 110 degrees Fahrenheit as identified by point 106 in FIG. 6. If, on the other hand, a preferred embodiment of the present invention is employed, the water temperature flowing through the coolant conduit 50 from the temperature responsive valve 34 would cause the oil 42 in the oil sump 40 to rise to approximately the temperature of that water flowing through the coolant conduit 50 as represented by dashed line 108 or slightly less when idling in cold lake water. This rise identified by dashed line 108 begins at point 110 when the temperature responsive valve 34 opens to allow warmed water to flow from the water jacket 22 to the coolant conduit 50 of the oil sump 40. Although not as warm as the optimum range 112, which is between 250 degrees Fahrenheit and 280 degrees Fahrenheit, the temperature identified by point 102 is significantly beneficial to that identified by point 106 which could induce condensation of fuel vapor into the oil and be accumulated within the sump 40.

With continued reference to FIG. 6, it should be understood that all of the lines that are graphically represented are intended to identify the changes in temperatures that would occur when the engine is operated at idle speed. Lines 104 and 108 represent the changes in oil temperature, without the present invention and with the present invention, respectively, when operated on a relatively cold day with lake water temperatures of approximately 30-40 degrees Fahrenheit. Line 114 represents the oil temperature, over time, when an engine which does not include the present invention is operated at idle speed on relatively warm days with lake temperatures in excess of 90 degrees Fahrenheit. Although higher than line 104, line 114 is still cooler than a desirable oil temperature. When water from the cooling jacket 22 is caused to flow in thermal communication with the oil 42, the oil temperature changes according to dashed line 118 beginning at point 120 when the temperature responsive valve 34 opens.

With continued reference to FIG. 6, it should be understood that, although the oil temperature is not shown as reaching the desired range 112, improvements are achieved by raising the oil temperature from that represented by lines 104 and 114 to that represented by line 100 when the engine is operated at idle speed on cold and hot days, respectively.

FIG. 7 is generally similar to that shown in FIG. 6, but the lines in FIG. 7 are intended to represent the changes in various temperatures when the engine 20 is operated at cruising speed in both cold and warm water. In comparing FIGS. 6 and 7, it should be understood that when operated at idle speed, the cooling and lubricating systems of an outboard motor engine often do not allow the coolant or the lubricant to rise significantly in temperature. The cooling water taken from the lake would eventually reach the operating temperature of the temperature responsive valve 34 in most cases, but the oil temperature is often affected by the fact that the oil sump is below the water level and is therefore continuously bathed in cold water. As a result, the oil temperature may not rise above that represented by line 104 in FIG. 6. When operated at cruising speed, as indicated in FIG. 7, the water temperature more rapidly achieves a magnitude that causes the temperature responsive valve 34 to open. However, in outboard motors which do not include the present invention, cooling water drawn from a cold lake may be sufficiently cold to inhibit the rise of oil temperature to desired levels even though the oil sump may be above the water level due to the marine vessel being on plane. As a result, it should be understood that the graphical representations in FIGS. 6 and 7 are intended to represent certain hypothetical results which can occur at both idle and cruising speed, in cold or warm water, and with or without the concepts of the present invention being implemented. It should therefore also be understood that changes in the coolant circuit of the outboard motor, the structure and position of the oil sump, and the structure of the oil sump can change the results represented in FIGS. 6 and 7.

In FIG. 7, the rise in water temperature in the water jacket 22 is again represented by line 100 which achieves a temperature indicated by point 102 which is typically about 140 degrees Fahrenheit. On a cold day, operating at cruising speed, the oil temperature profile would be approximately equivalent to that represented by line 130. If operated without the use of the present invention, the oil would eventually achieve a relatively stable temperature of approximately 250 degrees Fahrenheit as represented point 132 in FIG. 7. It should be understood that in this hypothetical representation by line 130, the oil temperature is affected by several parameters. The first, which is the operation of the engine at cruising speed, of approximately 6,000 RPM, causes the engine to achieve operating temperature relatively quickly and at a higher temperature magnitude than would typically occur when operated at idle speed. This increased temperature of the engine would normally raise the oil temperature to higher magnitudes than would occur at idle speeds. However, depending on the design of the cooling system and lubricating system of the engine, the use of cold lake water to cool the engine and oil sump would have a decreasing effect on the oil temperature, particularly in view of the fact that the oil pump 26 would be operated at maximum speed because it is driven by the engine. Therefore, the temperature represented by point 132 is below the optimum range 112 even though the engine is being operated at cruising speed, but in cold water. When the present invention is used, the oil temperature can follow the path represented by dashed line 134 and achieve the desired range 112. Even though the cooling water flowing from the water jacket 22 is only at 140 degrees Fahrenheit, it avoids the use of cold lake water to cool the oil sump 40 and thus allows the heating effects in the engine to raise the oil temperature to a much more desirable magnitude as represented by dashed line 134.

With continued reference to FIG. 7, line 140 represents the temperature profile of oil when the engine is operated at cruising speed on a hot day and in warm water when the present invention is not used. The oil eventually rises to a temperature of approximately 290 degrees Fahrenheit which is indicated by point 142 in FIG. 7. This temperature is above the desired range 112. However, if the present invention is used, the temperature profile would follow dashed line 144 beginning at the time when the temperature responsive valve 34 opens which is represented by point 146. This causes the oil temperature to stabilize within the desired range 112. In both of the situations illustrated in FIG. 7, which illustrate the oil temperatures, 130 and 140, when the present invention is not used in cold and warm water, respectively, and as represented by dashed lines 134 and 144 when the present invention is used in cold and warm water, respectively. The differences between the solid and dashed lines begin when the temperature responsive valve 34 begins to conduct water from the water jacket 22 to the oil sump 40 as represented by points 136 and 146.

With continued reference to FIGS. 6 and 7, it can be seen that the present invention does not always result in the oil temperature being within the most desired range 112, but it does moderate the oil temperature. The embodiments described above cause the oil temperature to rise within the sump 40 when it is below the cooling water temperature in the coolant conduit 50 and causes the oil temperature to be lowered when it is above the temperature of the water in the coolant conduit 50. This moderation of oil temperature provides a benefit under all circumstances of water temperature and operating conditions of the engine even though it does not always achieve the optimum operating temperature which is hypothetically represented by reference numeral 112 in FIGS. 6 and 7.

FIGS. 1-5 are highly schematic in nature for the purpose of clearly showing the basic concepts of the various embodiments of the present invention described above. In a particularly preferred embodiment, some characteristics of the outboard motor differ slightly from the highly schematic representations in FIGS. 1-5. As described above, the oil flowing downward from the lubricated surfaces of the engine 20 does not flow within a single conduit such as that identified by reference numeral 46. Instead, the lubricating oil cascades downward at multiple locations and is collected by the sump 40. Also, the sump 40 is illustrated in FIGS. 1-5 as having walls with both inner 76 and outer surfaces within the overall cavity defined by the driveshaft housing 12. It should be understood that, in a particularly preferred embodiment of the present invention, the oil sump 40 utilizes inner wall surfaces of the driveshaft housing itself as the outer surfaces of the coolant conduit 50. The inner surfaces 76 of the sump 40 are generally similar to those shown in FIGS. 1-5, but the coolant conduit 50 is much larger than the water containing coolant conduit 50 that is shown in the figures. Functionally, the present invention operates similarly in either configuration. Also, it should be understood that water flowing through the temperature responsive valve 34 can be directed into openings at the upper portion of the coolant conduit 50 and removed through openings in the lower portion of the coolant conduit 50 rather than at the upper portion where the discharge conduit 60 is shown to be connected to the coolant conduit. Furthermore, it should be understood that the coolant conduit 50 in a particularly preferred embodiment of the present invention, where the outer walls of the coolant conduit 50 are coincident with the inner walls of the driveshaft housing 12, a significant amount of water is contained in the coolant conduit, or coolant jacket, as it flows from the water jacket 22 of the engine 20 to the discharge conduit 60. This quantity of water within the coolant conduit 50 moderates the temperature of the oil 42 in two ways. First, the difference in temperature between the cooling water in conduit 50 and the oil 42 causes heat to be transferred between the cooling water and the oil. Secondly, and perhaps more importantly, the cooling water within the cooling conduit 50 acts as an effective insulating buffer which inhibits the exchange of heat between the oil 42 and the water of the body of water surrounding the outer surfaces of the driveshaft housing 12. It should therefore be understood that the configurations shown in FIGS. 1-5 are highly schematic and provided for the purpose of illustrating the basic concepts of various embodiments of the present invention and for showing the functional interconnections between various elements of the cooling and lubricating systems. Actual implementation of the concepts of the present invention will naturally modify certain sizes and shapes of the components and, in certain circumstances, change the relative positions of those components in relation to each other.

With reference to FIGS. 1-7, it can be seen that preferred embodiments of the present invention provide a marine propulsion device which comprises an engine 20, a water jacket 22 disposed in thermal communication with at least one heat producing portion of the engine 20, a water pump 26, a water inlet conduit 28 of the water jacket 22 connected in fluid communication with the water pump 26, a water outlet conduit 30 connected in fluid communication with the water jacket 22, a temperature responsive valve, 34 or 88, connected in fluid communication with the water outlet conduit 30 and configured to permit cooling water within the water jacket 22 to flow out of the water outlet conduit 40 when the temperature of the cooling water exceeds a predefined magnitude, such as 140 degree Fahrenheit, an oil sump 40 configured to contain a quantity of oil 42 for recirculation between the oil sump 40 and lubricated surfaces of the engine 20, and a coolant conduit 50 connected to the water outlet conduit 30 and disposed in thermal communication with the oil 42 of the oil sump 40, whereby the cooling water is directed to flow in thermal communication with the quantity of oil 42 after it passes through the water jacket 22 and reaches a temperature which exceeds the predefined magnitude controlled by the temperature responsive valve 34 or 88. The coolant conduit 50 is a coolant jacket which surrounds a portion of the oil sump 40 in one embodiment of the present invention. The system can further comprise a water discharge conduit 60 connected in fluid communication with the coolant conduit 50 in a preferred embodiment of the present invention. The water pump 26 can be configured to draw cooling water from a body of water, through conduit 62, and the cooling water is heated by thermal communication with at least one heat producing portion of the engine 20 and then subsequently conducted through the temperature responsive valve, 34 or 88, through the water outlet conduit 30, and the water discharge conduit 60 to be returned to the body of water. The temperature responsive valve, 34 or 88, the oil sump 40, and the coolant conduit 50 are configured to raise the temperature of the quantity of oil 42 when the temperature of the quantity of oil is less than the predefined magnitude of the temperature responsive valve and, alternatively, to lower the temperature of the quantity of oil 42 when the temperature of the oil is greater than the predefined temperature magnitude of the temperature responsive valve. Certain embodiments of the present invention can further describe a flow directing component 70 which is configured to cause the quantity of oil 42 to flow in contact with surfaces 76 of the oil sump 40 which are in thermal contact with the coolant conduit 50 as the quantity of oil 42 returns to the oil sump 40 from the lubricated surfaces of the engine. The flow directing component 70 can comprise at least one plate which directs the flow of the quantity of oil 42 into contact with the side surfaces 76 of the oil sump 40. The temperature responsive valve 34 can be a thermostat which is disposed in thermal communication with the cooling water within the water jacket 22 of the engine 20. Alternatively, the temperature responsive valve 88 can comprise a valve connected in electrical communication with a controller 92 which is connected in signal communication with a temperature sensor 90. The temperature sensor 90 is disposed in thermal communication with the cooling water within the water jacket 22 of the engine 20. The marine propulsion device can be an outboard motor 10.

Although the present invention has been described with particular specificity and illustrated to show several preferred embodiments, it should be understood that alternative embodiments are also within its scope.

We claim:

1. A marine propulsion device, comprising:

an engine;

a water jacket disposed in thermal communication with at least one heat producing portion of said engine;

a water pump;

a water inlet conduit of said water jacket connected in fluid communication with said water pump;

a water outlet conduit connected in fluid communication with said water jacket;

a temperature responsive valve connected in fluid communication with said water outlet conduit and configured to permit cooling water within said water jacket to flow out of said water outlet conduit when the temperature of said cooling water exceeds a predefined magnitude;

an oil sump configured to contain a quantity of oil for recirculation between said oil sump and lubricated surfaces of said engine; and a coolant conduit connected to said water outlet conduit and disposed in thermal communication with said oil sump, whereby said cooling water is directed to flow in thermal communication with said quantity of oil after it passes through said water jacket and reaches a temperature which exceeds said predefined magnitude.

2. The marine propulsion device of claim 1, wherein:

said coolant conduit is a coolant jacket which surrounds a portion of said oil sump.

3. The marine propulsion device of claim 1, further comprising:

a water discharge conduit connected in fluid communication with said coolant conduit.

4. The marine propulsion device of claim 3, wherein:

said water pump is configured to draw said cooling water from a body of water and induce said cooling water to flow through said water inlet conduit and said water jacket, said cooling water being heated by thermal communication with said at least one heat producing portion of said engine and then subsequently conducted through said temperature responsive valve, said water outlet conduit and said water discharge conduit and returned to said body of water.

5. The marine propulsion device of claim 1, wherein:

said temperature responsive valve, said oil sump, and said coolant conduit are configured to raise the temperature of said quantity of oil when the temperature of said quantity of oil is less than said predefined magnitude and to lower the temperature of said quantity of oil when the temperature of said quantity of oil is greater than said predefined magnitude.

6. The marine propulsion device of claim 1, further comprising:

a flow directing component configured to cause said quantity of oil to flow in contact with surfaces of said oil sump which are in thermal contact with said coolant conduit as said quantity of oil returns to said oil sump from said lubricated surfaces of said engine.

7. The marine propulsion device of claim 6, wherein:

said flow directing component comprises at least one plate which directs the flow of said quantity of oil into contact with side surfaces of said oil sump.

8. The marine propulsion device of claim 1, wherein:

said temperature responsive valve is a thermostat which is disposed in thermal communication with said cooling water within said water jacket of said engine.

9. The marine propulsion device of claim 1, wherein:

to said temperature responsive valve comprises a valve connected in electrical communication with a controller which is connected in signal communication with a temperature sensor, said temperature sensor being disposed in thermal communication with said cooling water within said water jacket of said engine.

10. The marine propulsion device of claim 1, wherein:

said marine propulsion device is an outboard motor.

11. An outboard motor, comprising:

an engine;

a water jacket disposed in thermal communication with at least one heat producing portion of said engine;

a water pump;

a water inlet conduit of said water jacket connected in fluid communication with said water pump;

a water outlet conduit connected in fluid communication with said water jacket;

a temperature responsive valve connected in fluid communication with said water outlet conduit and configured to permit cooling water within said water jacket to flow out of said water outlet conduit when the temperature of said cooling water exceeds a predefined magnitude;

an oil sump configured to contain a quantity of oil for recirculation between said oil sump and lubricated surfaces of said engine;

a coolant conduit connected to said water outlet conduit and disposed in thermal communication with said oil sump, whereby said cooling water is directed to flow in thermal communication with said quantity of oil after it passes through said water jacket and reaches a temperature which exceeds said predefined magnitude; and a water discharge conduit connected in fluid communication with said coolant conduit, said water pump being configured to draw said cooling water from a body of water and induce said cooling water to flow through said water inlet conduit and said water jacket, said cooling water being heated by thermal communication with said at least one heat producing portion of said engine and then subsequently conducted through said temperature responsive valve, said water outlet conduit and said water discharge conduit and returned to said body of water.

12. The outboard motor of claim 11, wherein:

said temperature responsive valve, said oil sump, and said coolant conduit are configured to raise the temperature of said quantity of oil when the temperature of said quantity of oil is less than said predefined magnitude and to lower the temperature of said quantity of oil when the temperature of said quantity of oil is greater than said predefined magnitude.

13. The outboard motor of claim 12, wherein:

said coolant conduit is a coolant jacket which surrounds a portion of said oil sump.

14. The outboard motor of claim 11, further comprising:

a flow directing component configured to cause said quantity of oil to flow in contact with surfaces of said oil sump which are in thermal contact with said coolant conduit as said quantity of oil returns to said oil sump from said lubricated surfaces of said engine.

15. The outboard motor of claim 14, wherein:

said flow directing component comprises at least one plate which directs the flow of said quantity of oil into contact with side surfaces of said oil sump.

16. The outboard motor of claim 11, wherein:

said temperature responsive valve is a thermostat which is disposed in thermal communication with said cooling water within said water jacket of said engine.

17. The outboard motor of claim 11, wherein:

said temperature responsive valve comprises a valve connected in electrical communication with a controller which is connected in signal communication with a temperature sensor, said temperature sensor being disposed in thermal communication with said cooling water within said water jacket of said engine.

18. An outboard motor, comprising:

an engine;

a water jacket disposed in thermal communication with at least one heat producing portion of said engine;

a water pump;

a water inlet conduit of said water jacket connected in fluid communication with said water pump;

a water outlet conduit connected in fluid communication with said water jacket;

a temperature responsive valve connected in fluid communication with said water outlet conduit and configured to permit cooling water within said water jacket to flow out of said water outlet conduit when the temperature of said cooling water exceeds a predefined magnitude;

an oil sump configured to contain a quantity of oil for recirculation between said oil sump and lubricated surfaces of said engine;

a coolant conduit connected to said water outlet conduit and disposed in thermal communication with said oil sump, whereby said cooling water is directed to flow in thermal communication with said quantity of oil after it passes through said water jacket and reaches a temperature which exceeds said predefined magnitude; and a water discharge conduit connected in fluid communication with said coolant conduit, said water pump being configured to draw said cooling water from a body of water and induce said cooling water to flow through said water inlet conduit and said water jacket, said cooling water being heated by thermal communication with said at least one heat producing portion of said engine and then subsequently conducted through said temperature responsive valve, said water outlet conduit and said water discharge conduit and returned to said body of water, said temperature responsive valve, said oil sump, and said coolant conduit being configured to raise the temperature of said quantity of oil when the temperature of said quantity of oil is less than said predefined magnitude and to lower the temperature of said quantity of oil when the temperature of said quantity of oil is greater than said predefined magnitude.

19. The outboard motor of claim 18, wherein:

said coolant conduit is a coolant jacket which surrounds a portion of said oil sump, said temperature responsive valve being a thermostat which is disposed in thermal communication with said cooling water within said water jacket of said engine.

20. The outboard motor of claim 18, further comprising:

a flow directing component configured to cause said quantity of oil to flow in contact with surfaces of said oil sump which are in thermal contact with said coolant conduit as said quantity of oil returns to said oil sump from said lubricated surfaces of said engine, said flow directing component comprising at least one plate which directs the flow of said quantity of oil into contact with side surfaces of said oil sump.

* * * * *